United States Patent [19]

Ishibachi et al.

[11] 4,341,260

[45] Jul. 27, 1982

[54] METHOD OF PRODUCING AMORPHOUS METAL TAPES

[75] Inventors: Toyoaki Ishibachi, Yokosuka; Masato Sakata, Yokohama, both of Japan

[73] Assignee: The Furukawa Electric Co., Ltd., Tokyo, Japan

[21] Appl. No.: 144,864

[22] Filed: Apr. 29, 1980

Related U.S. Application Data

[63] Continuation of Ser. No. 883,859, Mar. 6, 1978, abandoned.

[30] Foreign Application Priority Data

| | | | |
|---|---|---|---|
| Mar. 7, 1977 | [JP] | Japan | 52-24582 |
| Mar. 8, 1977 | [JP] | Japan | 52-25254 |
| Apr. 4, 1977 | [JP] | Japan | 52-38355 |
| Jan. 30, 1978 | [JP] | Japan | 53-9052 |
| Jan. 31, 1978 | [JP] | Japan | 53-9660 |

[51] Int. Cl.[3] ..... B22D 11/06

[52] U.S. Cl. ..... 164/463; 164/428

[58] Field of Search ..... 164/87, 427, 429, 432, 164/433, 434; 29/17 R, 18, 132; 72/199 X, 186; 264/93, 95, 216, 164; 425/223; 271/DIG. 2, 309, 314, 272, 274

[56] References Cited

U.S. PATENT DOCUMENTS

| | | | |
|---|---|---|---|
| 1,283,889 | 11/1918 | Pope | 271/DIG. 2 X |
| 1,595,478 | 8/1926 | Minton | 271/DIG. 2 X |
| 2,696,907 | 12/1954 | Fisk | 72/199 X |
| 3,622,059 | 11/1971 | Savela | 271/272 X |
| 3,862,658 | 1/1975 | Bedell | 164/87 |
| 4,084,806 | 4/1978 | Wenthe et al. | 271/314 |

OTHER PUBLICATIONS

"A Rapid Quenching Technique for the Preparation of Thin Uniform Films of Amorphous Solid", Chen. et al., Rev. Sci. Instrum. vol. 41, p. 1237 (1970).

*Primary Examiner*—Gus T. Hampilos
*Assistant Examiner*—K. Y. Lin
*Attorney, Agent, or Firm*—Armstrong, Nikaido, Marmelstein & Kubovcik

[57] ABSTRACT

A method is disclosed for the production of amorphous metal tapes by rolling and cooling a molten metal stream between the contact faces of one roll and one metal belt. Tapes having controlled dimensions may be obtained.

11 Claims, 10 Drawing Figures

METHOD OF PRODUCING AMORPHOUS METAL TAPES

This is a continuation, of application Ser. No. 883,859, filed Mar. 6, 1978 and now abandoned.

BACKGROUND OF THE INVENTION

This invention relates to an improved method of producing amorphous metal tapes. It is known that certain alloy melts usually containing one or more metalloids C, B, Si, P, Ge, etc. in amounts of about 20 to 40 atomic % can be made to solidify in the amorphous state by rapid cooling. Because of high cooling rates required to obtain the amorphous state from the liquid, amorphous metals must have at least one dimension small enough to ease the extract of heat from the melt, hence they are produced in the form of a tape.

Various laboratory techniques have been proposed to provide rapid cooling by spreading a melt in a thin layer against a cold substrate. Examples of these procedures include, among others, the single roll method, the centrifugal method, and the twin (double) roll method.

The single roll method consists in supplying a molten metal onto the surface of a rotating metal roll, in the form of a thin film or fine stream, so that the molten metal may be rapidly cooled by the roll to become a solidified tape. However, this method is not suitable for producing a tape having a large width nor for obtaining a tape having a uniform thickness.

The centrifugal method makes use of the inner surface of a rotating hollow metal cylinder as the cooling surface and is based upon a similar principle underlying the single roll method.

In these two methods the free surface of the melt receives no constraint during solidification so that the produced tapes often have uneven thicknesses in the width direction. In addition, since the force exerted on the tape to press it onto the cooling surface is weak, recesses or indentations are likely to be formed on the tape surface. Still another disadvantage is that undulations are apt to be formed in the longitudinal direction of the tape.

Further, the single roll method is capable of producing an amorphous metal tape only with selected compositions of the molten metal.

In the third method, i.e. the double roll method, a jet stream of a molten metal is introduced into the nip of a pair of rolls rotating at a high speed, and rolled and cooled simultaneously. This method requires frequent polishing of roll surfaces. In addition, when the rolls are used continuously for processing a long tape, the rolls soon lose their cooling capability, especially in the production of a wide tape. It is in no way possible to forcibly cool the rolls, by any known method.

Another problem inherent in this double roll method is the difficulty in bringing and maintaining the two rolls exactly parallel to each other.

Thus, the width of the tape obtainable by the double roll method is usually as small as 2 to 3 mm, and tapes having a width exceeding 10 mm can hardly be obtained unless a special technique is employed in the method of establishing a uniform roll contact. In addition, the reproducibility of tape dimensions in this method is poor.

Furthermore, since there is no escape between two rolls for the roughness of the roll surfaces, the roll surfaces are easily damaged. The defect of the roll surfaces, once it is formed, is copied onto the tape surface as protuberances. To avoid this, it is required to frequently polish the roll surfaces, which impairs the working efficiency considerably.

In order to overcome the above described shortcomings or drawbacks of the prior art, the present inventors formerly proposed an indirect double roll method in which a molten metal jet is rolled and cooled between two running metal belts backed up by two rotating rolls. This indirect double roll method is effective in that as far as the cooling capacity is concerned, it can afford an effect equivalent to that obtainable by the use of large diameter rolls, provided the lengths of the metal belts are made long enough. However, this advantage is offset by the variation in the roll gap and the belt thicknesses which add up directly to the tape thickness to be produced. In addition, this technique requires a complicated mechanism for driving the belts, and rolls without slippage.

For these reasons, this technique is also unsatisfactory.

DESCRIPTION OF THE INVENTION

Under these circumstances, the present inventors have succeeded in obtaining a novel method which overcomes the problems and shortcomings inherent in the conventional single and double roll methods, as well as the indirect double roll method.

According to one aspect of the invention, there is provided a method of producing long and wide amorphous metal tapes having superior dimensional accuracy wherein a molten metal jet of a composition capable of forming an amorphous metal upon rapid cooling is introduced into the nip formed by one rotating working roll and one contiguously running metal belt, and rolled and cooled, the contact between the roll and the belt being effected by providing a second, back-up, roll capable of exerting pressure on the metal belt.

Thus, the method in accordance with the invention is substantially different from the conventional single and double roll methods in which the molten metal is cooled by a roll surface or roll surfaces in that the cooling of the molten metal is achieved materially by the metal belt alone. In other words, it is a critical feature of the invention that the cooling by the working roll is only subsidiary, as compared with that by the metal belt. Thus, the working roll may be of metal or ceramic. Further, since the cold belt portion is continuously fed to form the cooling surface, the length of the obtainable tape is limited only by the length of the cooling belt used and no special technique is required in the method of supplying a molten melt.

Furthermore, according to the invention, the dimensional accuracy of the product tape is greatly enhanced simply by using a high precision working roll, because the flexible belt having a smooth surface can always follow up the rolling surface of the working roll, thus ensuring constant and parallel contact throughout the rolling region between the working roll and the metal belt.

Fluctuations in the tape thickness are diminished by providing a mechanism by which to resiliently press one roll, via the metal belt against the other by means of, say, a spring or a hydraulic or pneumatic cylinder. In this way, any disturbance arising from the belt thickness change can be absorbed into an elastic displacement of the pressing roll.

As an alternative measure which is more simple and more effective in obtaining the improved dimensional accuracy of the tape than the above pressing, it is proposed to use an elastic roll as the back-up roll which backs up the metallic belt from behind toward the working roll, thus providing a better and unchanging contact between the working roll and the metal belt.

The amorphous metal tape on which the present invention is focussed usually has a thickness of 10 to 50μ, and it is required that the thickness fluctuation fall within ±2μ for a mean thickness of 25μ.

By the method of the invention making use of an elastic roll for the backing up of the metal belt, such a severe dimensional control is achieved with ease and no additional processing is necessary such as polishing or lapping for providing the tape with a smooth and uniform surface.

The remarkable improvement in the dimensional control of the tape afforded by the use of an elastic back-up roll for backing up the metal belt is attributed partly to the faithful following up of the metal belt to the working roll surface, but also to the capability of the back-up roll to absorb any slight misalignment of the roll axes as well as any slight variation in the metal belt thickness.

Another advantage of the invention derived from the use of an elastic roll is that the nip area between the working roll and the metal belt is increared from a line contact to a face contact, thus affording a more effective rolling and cooling to the molten metal.

Furthermore, the elastic nature of the back-up roll helps to relieve excessive accidental loads from acting on the working roll and the metal belt, with the consequent result that the damage of these surfaces can be minimized or avoided.

When an elastic roll is used as the back-up roll, the elasticity of the roll is preferably small. Thus, for instance, a composite roll having an inner metal core covered with a hard rubber layer is preferred. In such a case, a thickness of the rubber layer two to three times as large as that of the belt, which usually has a thickness of 0.5 mm or smaller, is sufficient. Too large thicknesses of the rubber layer weaken the pressure to be exerted on the belt and cause an undesirable deformation of the roll during operation, and, therefore, is not preferred.

Alternatively, the back-up roll may be formed by simply winding a gum tape to one to three layers around a metal roll of 50 to 100 mm diameter, so that the layers of the gum tape may have a total thickness of about 1 mm or less. This back-up roll provides quite a satisfactory result, provided that the seam effect is ignored. A larger wear-resistant property will be ensured if a teflon layer is formed around a metal roll and then machined and finished.

On the other hand, the metal belt, which plays an essential roll in the present invention, must have a good surface smoothness, mechanical strength and flexibility, be it endless or with ends. From a practical point of view, the thickness is preferably 0.5 mm or less in case of a copper alloy belt, while it is preferably 0.4 mm or less with a steel belt. A width of two times as large as that of the desired tape will suffice.

It is neither possible nor necessary to define the material and thickness of the belt strictly, because the cooling capacity of the belt depends not only on the material and thickness adopted but also on other conditions such as rolling pressure, rolling speed, rolling system, melt composition and so forth. Indeed, any commercially available thin belt having a melting point of about 800° C. or above will do.

It must be stated, however, that, as a rule, a thick and narrow tape is produced with the use of a thick and high heat conductivity belt and a thin and wide tape with a thin and poor heat conductivity belt. This fact may, in turn, be used in controlling the tape dimensions.

The working roll of the invention may be of either metal or ceramic. In the selection of roll materials, consideration need not be given to cooling capacity which is ensured by the metal belt, nor to mechanical strength. The rolls suffer practically no load during processing. Thus, ordinary irons and steels make good rolls. Much softer copper or copper rolls are also usable. In general, rolls having a hard surface are preferable. Rolls may be optionally hardened by heat treatment or plating.

While metal rolls have the advantage of being inexpensive and easy to fabricate, they have also the disadvantage of being weak to thermal wear due to prolonged contact with a high temperature melt, thus demanding frequent polishing of the roll surface, as well as the preparation of a large number of stock rolls.

Heat-wear is observed to a varying degree in all metallic materials tested such as carbon steel (ASTM 1045), hot tool steels (ASTM H21, ASTM D2) and spring steel (ASTM 52100).

Since the surface roughness of a tape is a replica of that of a working roll used, resistance to thermal wear constitutes a requisite of utmost importance.

This disadvantage with metal working rolls can be overcome by the use of a ceramic roll. Ceramics exhibit a good resistance against heat and are never worn down nor corroded even when in prolonged contact with the molten metal.

Therefore, once a smooth surface is produced, the roll can stand long use without requiring repeated polishing.

In general, ceramic materials exhibit poor strength against mechanical and thermal impacts. Fortunately, the process of the invention is such that the working roll suffers practically no load or mechanical impact. In addition, experiments revealed that thermal impact causes no trouble with a ceramic roll. To ensure good thermal-impact resistance, a sleeve-like ceramic material is preferably combined with a metallic core to form a composite roll.

Any ceramic materials that can stand the temperature of the molten metal can be used. They may be chosen in consideration of the composition of the molten metal to be rolled, required tape surface, roughness, ease in fabrication and maintenance, durability and other economical requirements.

Ordinary oxide ceramics such as alumina, beryllia, titania, zirconia, magnesia, as well as silica including quartz, may be used as the roll material. Fine grained sintered alumina and molten ruby and sapphire are most desirable.

Further, the ceramic materials may be carbide ceramics (TiC, SiC), nitride ceramics (AlN,BN) or boride ceramics. As an alternative, a steel roll surface may be suitably treated to provide a surface layer of a boride, nitride, or carbide.

According to a second aspect of the invention, there is provided an improved method of producing long and wide amorphous metal tapes having superior dimensional accuracy wherein a molten metal jet of a composition capable of forming an amorphous metal upon rapid cooling is introduced into the nip formed by one rotating working roll and one contiguously running metal belt, and rolled and cooled, the contact between the roll and the belt being effected by providing a second, back-up, roll capable of exerting pressure on the metal belt and further by providing a third guide roll at a position closer to the working roll than to the back-up roll so that the contact may extend over part of the working roll surface on the delivery side (see, e.g., FIGS. 2 and 3).

The object of this latter method is to further enhance the rolling and cooling capacity of the method of the first aspect in which the rolling and cooling of the molten metal is effected only over a narrow region near the roll entrance.

According to this method of the second aspect, the rolling and cooling of the molten metal is performed over an extended region where the metal belt engages the working roll. The back-up roll which presses the metal belt toward the working roll prescribes the position at which the metal belt commences to cooperate with the working roll, while the guide roll acts to prescribe the position at which the cooperation of the working roll and the metal belt is terminated.

Consequently, according to the method of the second aspect, the area of rolling and cooling of the molten metal is further spread to a larger area, thus providing the melt with a better rolling and cooling. It now becomes possible to friction drive all the rolls by one belt alone without slippage, a simplifying feature of technical importance.

The length over which the metal belt cooperates with the working roll may be varied depending on the rigidity of the belt, running speed, moment of inertia of the working roll, pressure by which the metal belt is pressed onto the working roll, tension residing in the metal belt and so forth. However, one tenth of the entire circumference of the working roll is sufficient, and the tension applied to the metal belt may be as small as several kilogrammes.

At the same time, as is the case of the method of the first aspect, the precision of the product tape is remarkably enhanced by adopting an elastic roll as the back-up roll of the metal belt.

It is to be understood that in carrying out the method of the invention, means for adjusting the clearance between the metal belt and the back-up roll, means for applying a tension to the metal belt, means for driving the belt, means for supplying the molten metal and so forth are suitably combined and equipped to meet the object of the invention.

What has been said about the working roll and the cooling belt in the explanation of the method of the first aspect, applies, without alternations, to the method of the second aspect.

According to a third aspect of the invention, the method of the second aspect is further improved to avoid the accident attributable to a clinging of the tape to the roll, by adopting a gas jetting means (e.g., as shown in FIG. 5)

More specifically, according to the third aspect of the invention, there is provided a method of producing an amorphous metal tape wherein a working roll is rotated in contact with a metal belt which is backed up by a back-up roll and made to run, while a guide roll around which the metal belt goes is disposed at the delivery side of the metal belt and at a position closer to the working roll than to the back-up roll, so that the metal belt may run in contact over at least a part of the surface of working roll, so that a molten metal supplied to a point at which the working roll and the metal belt commences to cooperate is rolled and cooled, characterized in that means are provided at a position immediately downstream from the point at which the cooperation of the working roll and the metal belt terminates, for applying a gas jet onto the working roll surface in the reverse direction to the direction of rotation of the roll and, as required, that additional means are provided for applying a gas jet to a portion of the metal belt immediately downstream from the point of termination of the cooperation in the same direction as that of the tape.

Hereinafter, the preferred embodiments of the invention will be described with reference to the accompanying drawings wherein.

EMBODIMENT 1

Figure 1:
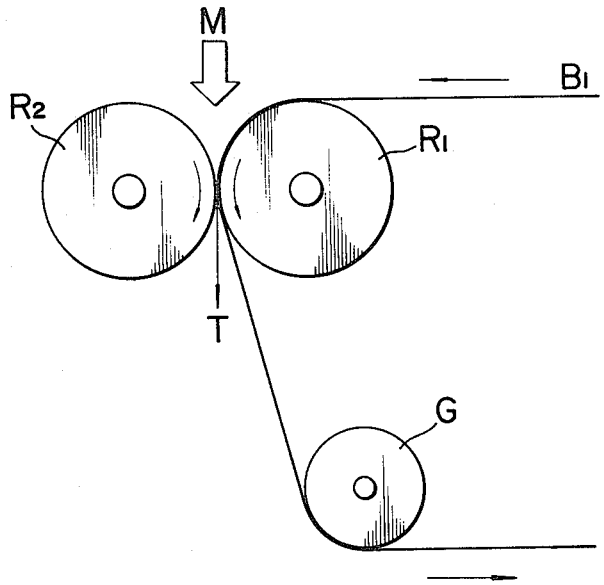
FIG. 1 is an illustration of essentials of a first and a second embodiment of the invention.

As shown in FIG. 1, a metal belt B1 is passed between a back-up roll R1 and a working roll R2. The metal belt B1 and the rolls R1, R2 are made to run rotate in the arrowed directions. A molten metal M is supplied to the nip of the metal belt B1 and the working roll R2, and rolled and cooled, under the following conditions, to become an amorphous metal tape T. Symbol G designates a guide roll.

Rolls:

Metal working roll (R2)

100 mm diameter, 40 mm t, mirror finished, ASTM 1045

Elastic back-up roll (R1)

Has two layers of gum tape to a total thickness of 1 mm.

Both the working roll R2 and the back-up roll R1 are supported by bearings to permit free rotation and they are friction driven by the belt B1. Further, the roll clearance between two rolls R1 and R2 can be adjusted.

Metal belt (B1)—open end type

Brass strip of 65/35 of 0.3 mmt×27 mmw×200 mL

Molten metal

Composition: 83.9% Co-5.3% Fe-8.5% Si-2.3% B (by weight)

Melting:

100 g of the above alloy was melted in a quartz glass tube of 16 mm diameter having an opening of 1.6 mm diameter at the bottom end, in a high frequency induction coil. The molten metal was pressurized to 0.2 atm by means of an argon gas. The molten metal was then ejected as a jet stream and introduced into the gap between the roll R2 and the belt B1 in an accurate manner.

Condition of rolling

Tension of belt B1: about 6 kg

Speed of roll R1: 1500 rpm

Clearance between roll R1 and belt B1: minus 5/100 mm minus means squeezing or shrinking. When the gap between the working roll and the back-up roll is equal to the thickness of the belt, the gap is regarded as being at the zero position. When the axis of one of the rolls draws closer to the axis of the other roll, from the zero position, the former axis is regarded as being a minus position.

Result

A tape having a beautiful surface and uniform dimensions 42μ(t)×10 mm(W)×42 m(L) the tailing end of the tape were both found completely cooled. A perfect amorphous nature of the tape was confirmed by a bending test and an x-ray examination. In addition, the tape exhibited the same satisfactory physical and mechanical properties as are obtained for a narrower tape of 2 to 3 mm wide. As to the fluctuation of thickness, the standard deviation was 2μ both in the longitudinal and the transverse direction of the tape.

A substantially similar result was obtained with the use of a metal roll same as the working roll R2 for a back-up roll and at a roll clearance of −1/100except that the thickness deviation was increased to 3μ, a value still acceptable. This deviation of thickness was reduced to 2.5 by resiliently supporting the back-up roll by a spring.

EMBODIMENT 2

Same system as that shown in FIG. 1 was used but the metal working roll was replaced by a ceramic roll.

Rolls:

Ceramic working roll (R2)

100 mm diameter 40 mm t, finished by polishing (A composite roll consisting of an outer alumina ring of 100 diameter×70 diameter and an inner steel ring of 70 diameter×40 diameter)

Elastic back-up roll (R1)

A metal roll of 100 diameter coated with a 20 mm thick silicon rubber.

Other conditions being the same as in Embodiment 1.

Result

A tape having substantially the same properties and dimensions as in the first test of Embodiment 1 was obtained. No roughening of the ceramic roll surface was observed after the test.

Further, in this embodiment, quartz (solid), zirconia (solid), sapphire, silicon carbide (solid), aluminum nitride and iron nitride (to a depth of 20μ on a ASTM D2 roll) rolls were tested and all found satisfactory. None of them showed surface roughening.

EMBODIMENT 3

Figure 2:
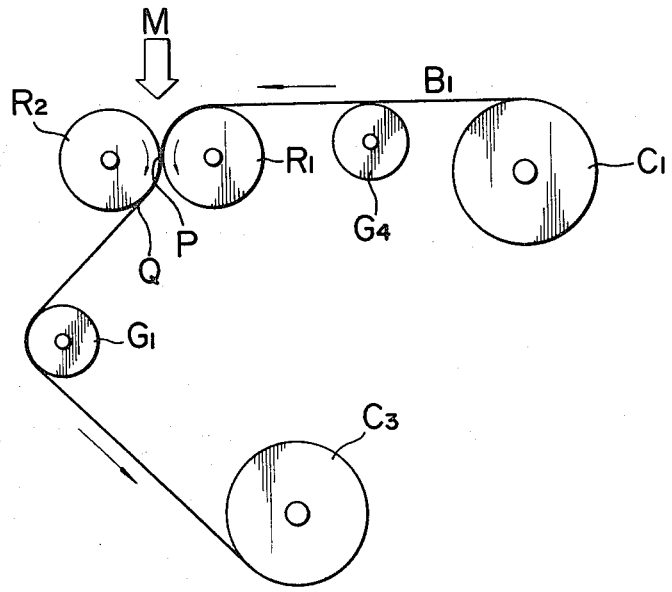
FIG. 2 is an illustration of essentials of a third and a fourth embodiment of the invention.
Figure 3:
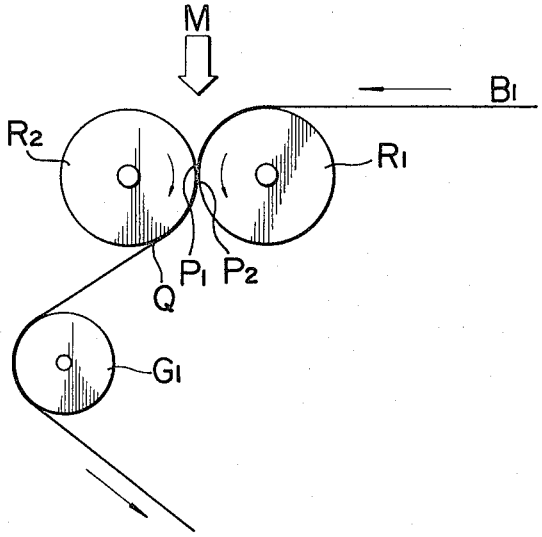
FIG. 3 is a partial enlarged view of FIG. 2.
Figure 4:
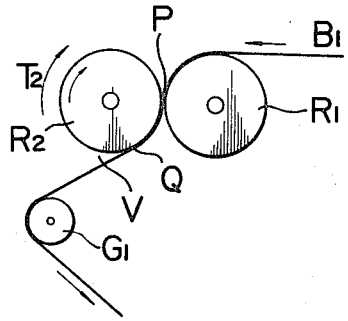
FIG. 4 is an illustration of an accident due to a clinging of the tape to the working roll in the systems as shown in FIGS. 2 and 3.

The processing was carried out by a method as illustrated in FIGS. 2 and 3, in accordance with the following conditions.

Rolls:

Metal working roll (R2)

100 mm diameter×40 mmt, mirror finished

Back-up roll (R1)

Same metal roll as the working roll (R2) but having double surface layers of gum tape wound to a total thickness of 1 mm. Both rolls are made of ASTM 1045, and are supported by bearings, to permit free rotation.

Metal belt (B1)

65/35 brass strip of 0.3 mmt×27 mmW×200 mL

Pay-off reel (C1)

Made of aluminum and equipped with a powder brake.

Starting diameter is 26 cm.

Take-up reel (C3)

Same as the pay-off reel. Driven by a 2 HP variable speed motor at a speed of about 1,000 rpm.

Guide roll (G4)

60 mm diameter having a groove of 27.5 mm wide and 3 mm deep

Guide roll (G1)

Same as C4

The metal belt B1 starting from the reel C1 is passed via the guide roll G4, onto the back-up roll R1, and through the nip point P between the metal working roll R2 and the back-up roll R1. The belt B1 then turns around the metal working roll R2 over a part PQ and is taken up by the reel C3 via the guide roll G1. In the nip point P, is established a face contact over an arc $\widehat{P1P2}$ due to the elastic deformation of the back-up roll R1, as will be seen from the enlarged view of FIG. 3. The clearance between the rolls R1 and R2 is set to −5/100 mm (symbol − represents tightening of the nip or narrowing the clearance, while symbol ÷ represents loosening or widening, the zero (0) clearance means the minimum roll gap below which compression by the back-up roll sets in R1.) the tension applied to the metal belt B1 is about 6 kg.

Molten metal

Composition: 83.9% Co-5.3% Fe-8.5% Si-2.3% B (by weight)

Melting:

100 g of the above alloy was melted in a quartz glass tube of 16 diameter having an opening of 1.6 mm diameter at the bottom end, in a high frequency induction coil. The molten metal (M) was then pressurized to 0.2 atm by an argon gas, injected and introduced precisely into the gap between the roll R2 and the belt B1.

Result

A tape having substantially the same properties and dimensions as in the first test of Embodiment 1 was obtained.

In another test with the use of a 0.22 mm thick soft steel belt and at a somewhat widened roll clearance of −1/100 mm, a tape having a beautiful surface and dimensions of 30μ(t)×14 mm(W)×40 m(L) was obtained. No difference in physical and mechanical properties was detected between the leading and the tailing end.

Still in another test with the use of a metal roll same as the working roll R2 for a back-up and at a roll gap of −1/100 mm, the thickness deviation was increased to 3μ. This could be reduced to 2μ by increasing the belt tension to 10 kg.

EMBODIMENT 4

The tape was produced by the method as shown in FIGS. 2 and 3, in accordance with the following conditions.

Rolling condition

Ceramic working roll (R2)

A composite roll consisting of an outer alumina ring of 100 diameter OD×85 diameter ID and an inner metal ring of 85 diameter OD×40 diameter ID.

Back-up roll (R1)

A metal roll of 100 diameter coated with a teflon layer of 10 mm thick. The material of roll was ASTM 1045. Other conditions being the same as in Embodiment 3.

Result

A tape having substantially the same properties and dimentions as in the test of Embodiment 3 was obtained.

Then, tests were carried out in the same condition but the material of the ceramic roll substituted by mullite, sapphire, zirconia, beryllia, silica (solid), magnesia, aluminum nitride, boron nitride and nitrogen carbide (solid), and the material of the metal belt substituted by spring steel SK4. Completely amorphous metal tapes were obtained and no roughening of the ceramic roll surface were observed in each case.

EMBODIMENT 5

The critical features of the embodiments 3 and 4 as shown in FIGS. 2 and 3 reside in that the guide roll G1 is disposed at the delivery side of the roll R2 so that the metal belt B1 may be put into surface contact with a part of the circumference of the roll R2. However, this technique involves a problem that the tape (T) is likely to cling to the working roll R2.

Namely, in the normal state of operation, the rolled tape is carried by the belt B1 and delivered in the direction of an arrow T1. However, it is often experienced that the tape is delivered in the direction of an arrow T2 to cling the working roll R2, so as to be rolled again.

One of the reason for this clinging accident is that the tape after rolling inherently has a tendency to cling to the roll R2, because it has been rolled around the latter. This tendency gets remarkable as the diameter of the roll is reduced and as the contacting area is increased.

The embodiment 5 is prepared for this clinging of the tape to the roll.

Figure 5:
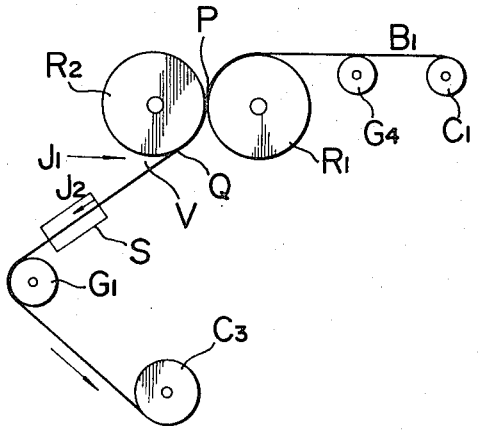
FIG. 5 is an illustration of a fifth embodiment of the invention.
Figure 6:
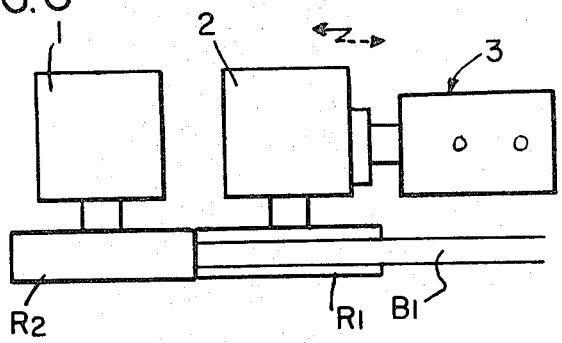
Figure 6A:
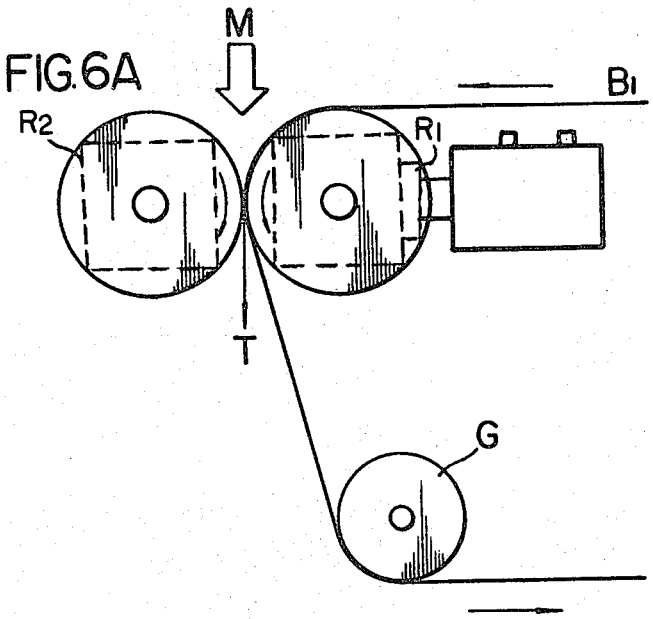
Figure 7:
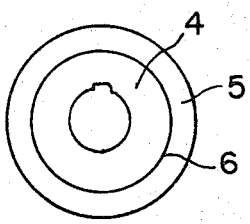
Figure 8:
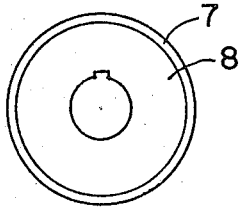
Figure 9:
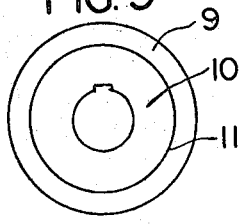

Referring to FIG. 5, means are provided for applying a gas jet J1. The arrangement is such that the gas jet J1 is once directed toward the surface of the working roll R2, and is then deflected toward the space V. This gas jet J1 functions to negate the pressure reduction in the space V and to press the tape onto the surface of the belt B1 apart from the roll R2. In addition to these effects, this gas jet J1 further provides a remarkable effect of cooling of the tape. The medium of the gas jet is preferably air, inert gas and the like, and a pressure of 1 to 5 atm is sufficient although it depends on various conditions such as diameter of the gas nozzle, distance between the nozzle and the space (V), position on the working roll R2 at which the belt B1 comes to contact and so forth.

The nozzle preferably has an elongated cross-section similar to rectangular, rather than circular, so that the jetted gas may effectively sweep the roll surface.

For further enhancing the effect of the invention, it is preferred to provide a sleeve S adapted to cover the running surface of the tape B1 at a region between the working roll R2 and the guide roll G1, as shown in FIG. 5, and to make another gas jet J2 flow through the sleeve S toward the guide roll G1. This conveniently ensures the tape having left the roll R2 to be attracted into the sleeve S.

The combined use of the gas jets J1 and J2 is preferred because of the increased effect of clinging prevention, although the gas jet J1 or J2 may be used solely.

Rolling condition

Metal roll (R2)

100 mm diameter, 40 mm t, mirror finished

Back-up roll (R1)

A gum tape is wound doubly around the same roll as the metal roll R2 to form a surface layer of 1 mm thick. ASTM 1045 was used as the material of both metal rolls R1 and R2. The rolls were rotatably supported by bearings, and the clearance therebetween was made adjustable.

Metal belt (B1)

65/35 brass strip of 0.3 mmt×27 mmW×200 mL

Pay-off reel (C1)

Equipped with powder brake, made of aluminum, initial winding diameter is 26 cm.

Take-up roll (C3)

Same as the reel C1. Driven by a 2 HP variable revolution speed of about 1,000 rpm.

Guide roll (G4)

60 mm diameter, Equipped with groove of 27.5 mmW

Guide roll (G1)

Provided with groove, 60 mm diameter

The arrangement was such that the metal belt B1 paid off from the reel C1 is lead to the back-up roll R1 via the guide roll R1 and then passed through the nip point P between the back-up roll R1 and the metal roll R2. The belt B1 then makes a turn in contact with a part PQ of the circumference of the metal roll R2, and is finally taken up by the reel C3 via the guide roll G1. The tension in the belt B1 was about 6 kg as measured from the braking electric current.

Gas jet (J1)

This is applied to the surface of the roll R2 immediately downstream from the point at which the belt B1 leaves the roll R2, in the tangential direction of the roll R2 so as to be deflected toward the space V. The gas of jet has a room temperature and jetted at a pressure of 1 to 5 atm, from a nozzle having a rectangular opening of 10 mm wide.

Condition of molten metal

Composition: 83.9% Co-5.3% Fe-8.5% Si-2.3% B (by weight)

Melting: 100 g of material was molten in a quartz glass of 16 mm diameter having a bottom nozzle port of 1.6 mm diameter. The molten metal was then pressurized by argon gas to a pressure of 0.2 atm and was injected and introduced to the point P at which the belt B1 commences to contact the roll R2.

Result

A tape (T) having an attractive appearance of 4.2μ(t)×10 mm(W)×42 mm(L) was obtained. The leading and the trailing side ends of the tape was found to have been cooled completely. Physical characteristics such as magnetic characteristic and hardness were found acceptable for narrower tape of 2 to 3 mm wide. As to the thickness fluctuation, the thickness deviation was as small as 2μ in both breadthwise and longitudinal directions of the tape.

Tests were carried out in the same condition but neglecting the gas jet J1. As a result, clinging accident was caused once for each 5 (five) rolling operation. However, when the gas jet J1 was used, no accident was caused during about 100 times of repeated rolling operation. This means that the effect of the gas jet J1 is remarkable.

What is claimed is:

1. A method of producing long, wide amorphous metal tapes having a thickness of less than 0.05 mm, and having a superior dimensional accuracy comprising:

introducing a molten jet of a composition capable of forming an amorphous metal upon rapid cooling directly into a contact nip area formed between a first rotating, working roll, whose surface is comprised of metal, and a contiguous, long open-end, flexible metal belt;

simultaneously rolling and cooling said molten metal on both sides by said working roll and said belt within said contact area, said contact being effected by providing a second, back-up roll whose surface is comprised of elastic material, and wherein said back-up roll presses elastically said metal belt against said working roll, and both rolls being friction-driven by said metal belt, and wherein said contact nip area formed between said working roll and said metal belt is elastically closed prior to said spraying of said molten metal and is elastically expanded by solidified metal passing into said contact area.

2. A method of producing long, wide amorphous metal tapes as in claim 1, further comprising:

increasing the surface contact area between said working roll and said open-end belt over a portion of the circumference of the surface of said working roll on a side of said working roll from which said tape is being taken up, by providing a third, guide, roll at a position closer to said working roll than said back-up roll.

3. A method for producing a long, wide amorphous metal tape as put forth in any of claims 1 or 2, further comprising:

applying a gas to a portion of said working roll surface immediately downstream from a point of the surface circumference of said working roll at which said working roll surface departs away from said metal belt, said gas jet being applied in a reverse direction to the direction of rotation of said working roll.

4. A method of producing a long, wide amorphous metal tape having a superior dimensional accuracy comprising:

introducing a molten jet of a composition capable of forming an amorphous metal upon rapid cooling directly into a contact nip area between a rotating, working roll and a back-up roller, a surface of said back-up roller pressing a contiguous long open-end, flexible metal belt against said working roll;

driving said working roller and said back-up roller by said metal belt;

simultaneously rolling and cooling said molten metal by said working roll and said belt within said nip contact area;

wherein said contact nip area is closed prior to said introduction of said molten material and is expanded by solidified metal passing into said contact area.

5. A method according to claim 4, wherein said cooling of said amorphous metal is performed primarily by said metal belt.

6. A method according to claim 4, wherein said working roller is metal.

7. A method according to claim 4, wherein said working roller is ceramic.

8. A method according to claim 4, wherein said pressing is by one of a spring and a hydraulic or penumatic cylinder.

9. A method according to claim 4 or 6, wherein said surface of said back-up roller is an elastic material and wherein said back-up roller elastically presses said metal belt against said working roller.

10. A method according to claim 4, wherein the thickness fluctuation of the tape is maintained within $\pm 2\mu$ for a mean tape thickness of $25\mu$.

11. A method according to claim 4, wherein said working roll is a sleeve-like ceramic material combined with a metallic core.

* * * * *

UNITED STATES PATENT AND TRADEMARK OFFICE

CERTIFICATE OF CORRECTION

PATENT NO. : 4,341,260

DATED : July 27, 1982

INVENTOR(S) : ISHIBACHI et al.

It is certified that error appears in the above-identified patent and that said Letters Patent are hereby corrected as shown below:

Column 10, line 41, delete "4.2μ" and insert --42μ--.

Column 10, line 41, delete "42mm" and insert --42m--.

Signed and Sealed this

Twenty-ninth Day of May 1984

[SEAL]

Attest:

GERALD J. MOSSINGHOFF

Attesting Officer

Commissioner of Patents and Trademarks